US007819441B1

(12) United States Patent
Coman et al.

(10) Patent No.: US 7,819,441 B1
(45) Date of Patent: Oct. 26, 2010

(54) MAGNETIC OPEN DOOR RETAINER FOR A MOTOR VEHICLE CONVEYANCE COMPONENT

(75) Inventors: Ronald E Coman, 5789 Kinyon Dr., Brighton, MI (US) 48116; Brendan M Murray, Brighton, MI (US)

(73) Assignee: Ronald E Coman, Brighton, MI (US)

( * ) Notice: Subject to any disclaimer, the term of this patent is extended or adjusted under 35 U.S.C. 154(b) by 63 days.

(21) Appl. No.: 11/156,304

(22) Filed: Jun. 17, 2005

(51) Int. Cl.
*E05C 17/56* (2006.01)
*E05C 19/16* (2006.01)

(52) U.S. Cl. ..... 292/251.5; 292/288; 292/DIG. 15; 292/DIG. 19; 16/82

(58) Field of Classification Search ..... 292/251.5, 292/288, DIG. 15, DIG. 19; 16/82, 85
See application file for complete search history.

(56) References Cited

U.S. PATENT DOCUMENTS

| | | | | | |
|---|---|---|---|---|---|
| 2,519,435 | A | * | 8/1950 | Byrd, Jr. | 292/251.5 |
| 2,877,361 | A | | 3/1959 | Chase | |
| 3,009,725 | A | * | 11/1961 | Koch | 292/251.5 |
| 3,244,443 | A | * | 4/1966 | Rodgers | 292/251.5 |
| 3,533,652 | A | * | 10/1970 | Crane et al. | 292/251.5 |
| 3,734,553 | A | * | 5/1973 | Sugasawara | 292/251.5 |
| 3,913,958 | A | * | 10/1975 | Larime | 292/251.5 |
| 3,934,909 | A | | 1/1976 | Van Natter | |
| 4,099,755 | A | | 7/1978 | Anderson | |
| 4,669,766 | A | * | 6/1987 | Hanchett et al. | 292/251.5 |
| 4,995,655 | A | * | 2/1991 | Freeman | 292/251.5 |
| 5,010,622 | A | * | 4/1991 | Morita | 16/85 |
| 5,082,317 | A | * | 1/1992 | Delaney, Jr. | 292/251.5 |
| 5,139,293 | A | * | 8/1992 | Zimmerman et al. | 292/251.5 |
| 5,251,362 | A | | 10/1993 | Riceman et al. | |
| 5,758,913 | A | * | 6/1998 | Roth et al. | 292/251.5 |
| 5,836,049 | A | * | 11/1998 | Chiang | 16/82 |
| 5,887,917 | A | * | 3/1999 | Luciana | 292/251.5 |
| 5,983,464 | A | * | 11/1999 | Bauer | 24/303 |
| 6,089,588 | A | * | 7/2000 | Lesesky et al. | 280/422 |
| 6,588,811 | B1 | | 7/2003 | Ferguson | |
| 2002/0043813 | A1 | | 4/2002 | McManus et al. | |
| 2002/0109445 | A1 | | 8/2002 | Sears | |
| 2002/0162939 | A1 | | 11/2002 | Heidrich | |
| 2003/0180090 | A1 | | 9/2003 | Okuda | |
| 2003/0229974 | A1 | | 12/2003 | Zemer et al. | |
| 2004/0183313 | A1 | | 9/2004 | Sherman et al. | |
| 2004/0258471 | A1 | | 12/2004 | Granata | |

OTHER PUBLICATIONS

Six Examples of Semi-Trailer Rear Door Mechanical Linkage Open Door Holders of Fleet Engineers, Inc of Muskegon, MI 49442 Believed on Market Since Before Jun. 2004.

* cited by examiner

*Primary Examiner*—Carlos Lugo
(74) *Attorney, Agent, or Firm*—Peter D. Keefe

(57) ABSTRACT

An operatively automatic magnetic open door retainer for motor vehicle conveyance components, as for example semi-trailers. The magnetic open door retainer includes a pair of magnetic source members, each magnetic source member being attached to a respective one of the left and right doors of the motor vehicle conveyance component and a pair of magnetically attractive plates attached to the sidewalls of the motor vehicle conveyance component. When a door is in its fully open state, its respective magnetic source member will magnetically clamp to the respective magnetically attractive plate.

4 Claims, 6 Drawing Sheets

MAGNETIC OPEN DOOR RETAINER FOR A MOTOR VEHICLE CONVEYANCE COMPONENT

TECHNICAL FIELD

The present invention relates to conveyance components used in motor vehicle applications, as for example semi-trailers. More particularly, the present invention relates to open door retainers for retaining open one or more doors in adjacency with one or more respective sidewalls of the conveyance component. Still more particularly, the present invention relates to a magnetic open door retainer for a conveyance component.

BACKGROUND OF THE INVENTION

A motor vehicle conveyance component of particular interest is a semi-trailer conveyance component of heavy-duty trucks, wherein a driver operated tractor is selectively connectable thereto. In this regard, the semi-trailer is composed of a deck (floor) having a peripheral lower side-rail and a roof having a peripheral upper side-rail. Between the upper and lower side-rails are left and right sidewalls, a front wall and left and right doors, each door being hinged to a respective one of the left and right sidewalls.

Referring now to FIGS. 1A and 1B, the operation of the doors of a semi-trailer 10 will be discussed. The left and right doors 12L, 12R are held in a closed state by one or more latch rods 14, which interfacingly seat with respect to the upper and lower side-rails of the semi-trailer 10 to hold the doors securely closed for over the road transportation. When the time comes to load or unload the semi-trailer, the latches are unseated with respect to the upper and lower side-rails, and the left and right doors swung open on hinges connected to the respective left and right sidewalls of the semi-trailer 10.

An open doors situation requires a great deal of care, in that the wind could catch a door and cause it to pivot undesirably, even dangerously. Additionally, it is necessary for the left and right doors to be kept in a fully open state, wherein the doors are adjacent their respective left and right sidewalls, as a semi-trailer is backed into the dock opening at a truck depot facility so as to avoid damage caused by impact of a partially open door with the dock opening or an adjacent structure, such as for example another semi-trailer.

The solution long adopted by the trucking industry is to secure the doors in a fully open state via a mechanical open door retainer 18 in the form of either a chain or a bungee which is selectively secured to the lower side-rail. In the operative example shown at FIG. 1B, a chain 18*a* is full-time secured respectively to each of the left and right doors, and the free end thereof secured to a hook 18*b* located at the lower side-rail 16 of the respective left and right sidewalls (the left sidewall 20L being shown at FIG. 1B).

While a conventional mechanical open door retainer does provide retention of the doors in the fully open state, there are a number of drawbacks and/or problems associated with it. One major problem is that the semi-trailer operator must make a conscious effort to secure operation of a mechanical open door retainer, its operation is not automatic. Other disadvantages and/or problems include: the chains or bungees may loosely swing during over the road transportation; the hook may become bent, obstructed by ice or debris, or become otherwise inoperable; the chains are often broken when the door is forced open rendering them useless; the chains or bungees may shake loose when fork lifts drive into and out of the semi-trailer thereby allowing the doors to slam back and forth against the sidewalls, or adjacent structure, as a forklift moves in and out, the truck is moving or is buffeted by wind.

Accordingly, it would be a very advantageous advance of semi-trailer trucking technology if somehow an open door retainer could be devised which operated automatically and has none of the problems or disadvantages of the present mechanical open doors retainer. In addition, it would be advantageous if the aforesaid open door retainer had application to all manner of conveyance components used in the motor vehicle arts, including for example and without limitation, trailers, shipping containers, delivery vans, covered utility trailers, moving vans, wagons, etc.

SUMMARY OF THE INVENTION

The present invention is a magnetic open door retainer for a motor vehicle conveyance component which operates automatically and has none of the problems or disadvantages of conventional mechanical open door retainers, having application to all manner of conveyance components used in the motor vehicle arts, including for example and without limitation, semi-trailers, trailers, shipping containers, delivery vans, covered utility trailers, moving vans, wagons, etc.

In that the environment of the present invention involves a motor vehicle application in which, among other factors, movement, impact, flexing, vibration, weather (including wind, rain, snow and ice) and road conditions (including road salt) play significant roles during operation, the present invention requires a unique solution to apply magnetics to an open door retainer. Prior art magnetic door latches for such things as cabinet doors and pool gates, do not address the unique factors associated with a motor vehicle conveyance component open door retainer, and are, therefore, of no avail.

The magnetic open door retainer according to the present invention includes a pair of magnetic source members, each magnetic source member being attached to a respective one of the left and right doors of the conveyance component. By the term "conveyance component" is meant to include without limitation any enclosed motor vehicle conveyance component, wherein one or more doors thereof are rotatable between a closed state and a fully open state whereat the door is adjacent a sidewall of the conveyance component, including for example without limitation: trailers, semi-trailers, shipping containers (particularly as used on flat bed trucks), delivery vans, covered utility trailers, moving vans, wagons, etc.

In a preferred embodiment of the magnetic open door retainer according to the present invention, each magnetic source member is composed of a high magnetic field density magnet, most preferably a permanent magnet, which is seated in a cavity of an elastomeric body. A non-magnetic pad is located at, and covers over, the magnet and the cavity. The elastomeric body is attached to a selected door. In the event the left and right sidewalls of a conveyance component are nonmagnetic (being composed typically of plywood backed aluminum), a magnetically attractive plate is respectively attached to each of the left and right sidewalls where the respective magnetic source member meets the sidewall when the door is in its fully open state.

In operation, the operator opens the door, or the left and right doors, then rotates the door/doors one at a time into the fully open state, whereupon the magnetic source member clamps magnetically to a respective magnetically attractive plate and thereby automatically holds the door/doors in the fully open state. The magnetic clamping is sufficient to hold each door adjacent the sidewall, but is easily unclamped by the operator tugging on the door when it is desired to return the door/doors to their closed state.

Accordingly, it is an object of the present invention to provide a magnetic open door retainer for a motor vehicle conveyance component which operates automatically.

This and additional objects, features and advantages of the present invention will become clearer from the following specification of a preferred embodiment.

DESCRIPTION OF THE PREFERRED EMBODIMENT

Figure 1A:
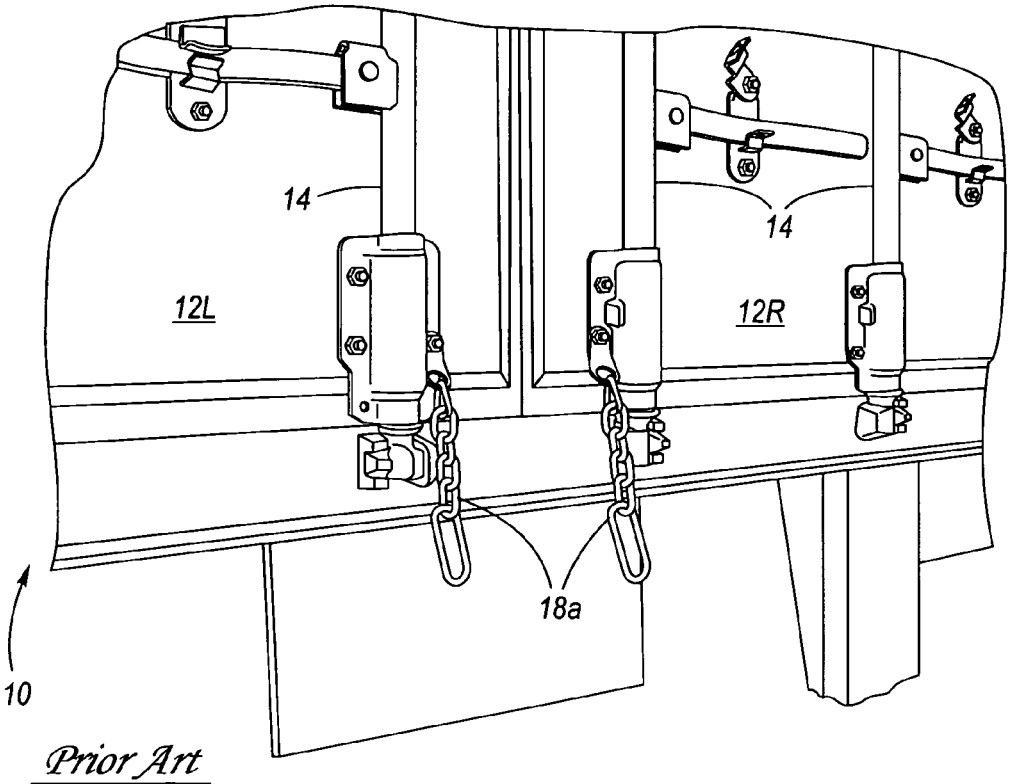
Prior Art Fig. 1A
FIG. 1A is a broken-away view of a rear portion of a conventional semi-trailer.
Figure 1B:
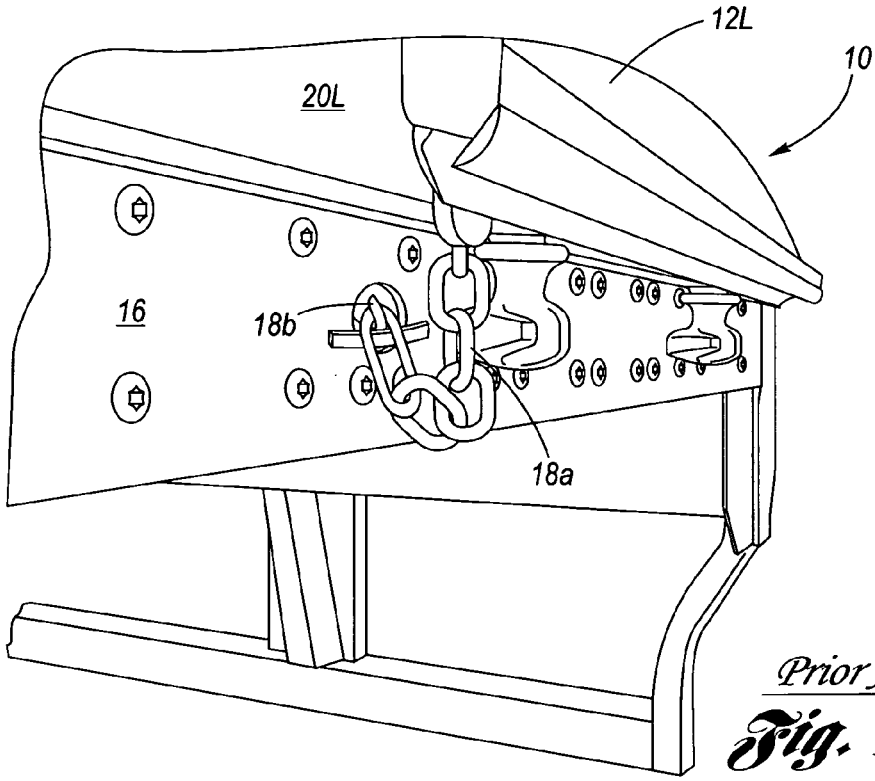
Prior Art Fig. 1B
FIG. 1B is a broken-away view of a side portion of a conventional semi-trailer, showing a conventional mechanical open door retainer in operation.

Referring now to the Drawing, FIGS. 2 through 12B depict various aspects of a preferred embodiment of a magnetic open door retainer 100 for a motor vehicle conveyance component 400 according to the present invention, wherein hereinafter the term "motor vehicle conveyance component" shall be referred to, for brevity, simply as a "conveyance". By the term "conveyance" is meant to include without limitation any enclosed motor vehicle conveyance component wherein one or more doors thereof are rotatable between a closed state and a fully open state whereat the door is adjacent a sidewall of the conveyance, including for example without limitation: trailers, semi-trailers, shipping containers (particularly as used on flat bed trucks), delivery vans, covered utility trailers, moving vans, wagons, etc., and wherein, merely by preferred example, a semi-trailer is depicted in the Drawing.

Figure 2:
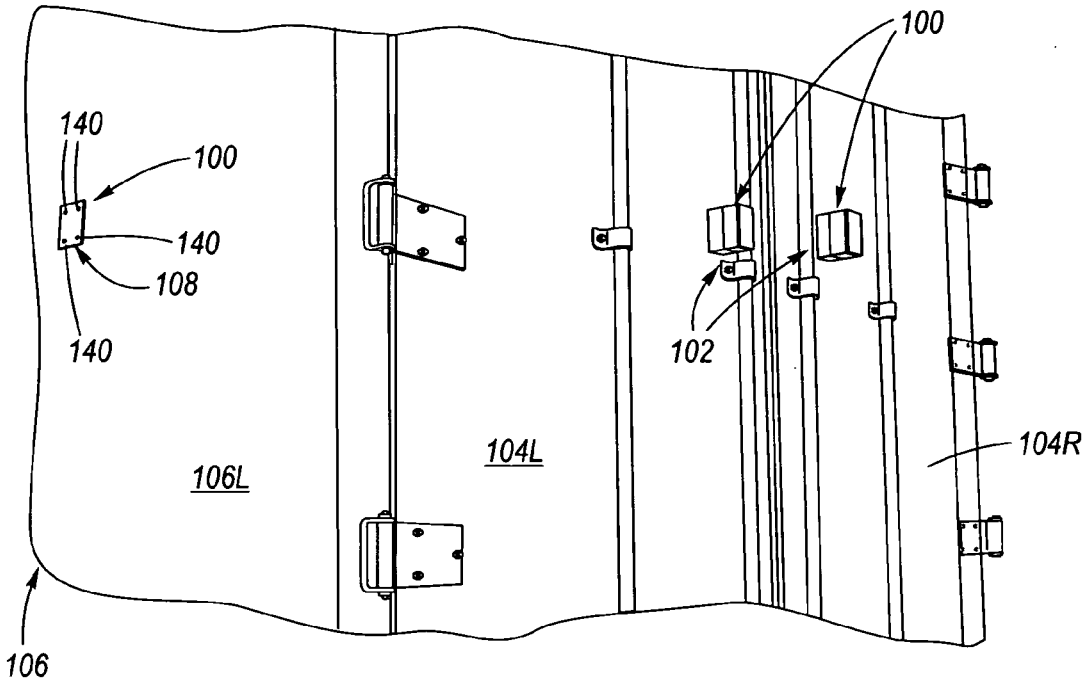
FIG. 2 is a broken-away view of a left-rear corner portion of a semi-trailer equipped with a magnetic open door retainer for a motor vehicle conveyance component according to the present invention.
Figure 3:
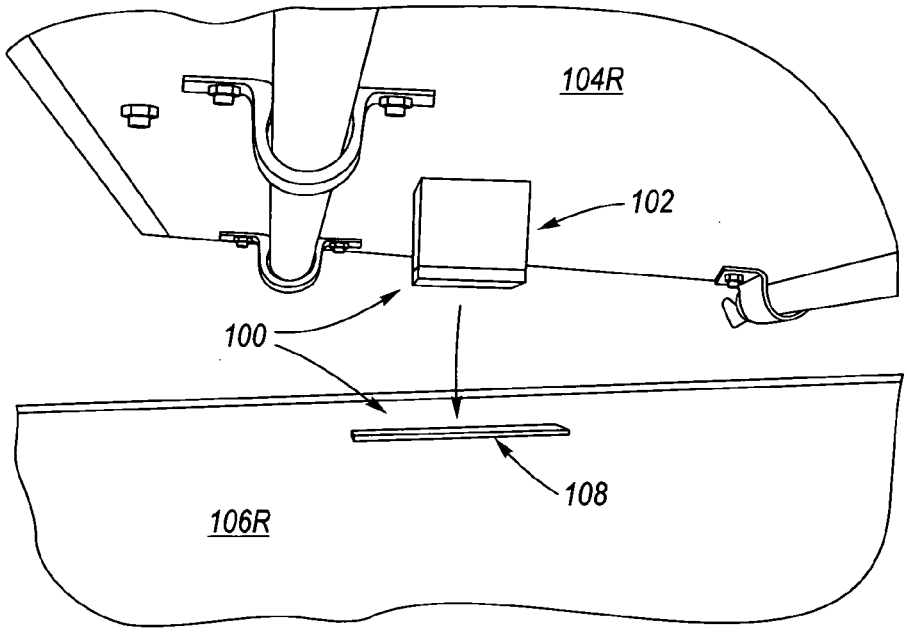
FIG. 3 is a broken-away, downward view of the semi-trailer equipped with the magnetic open door retainer for a motor vehicle conveyance component according to the present invention, showing a mid-stage of rotation of a right door and right sidewall of the conveyance component.
Figure 4:
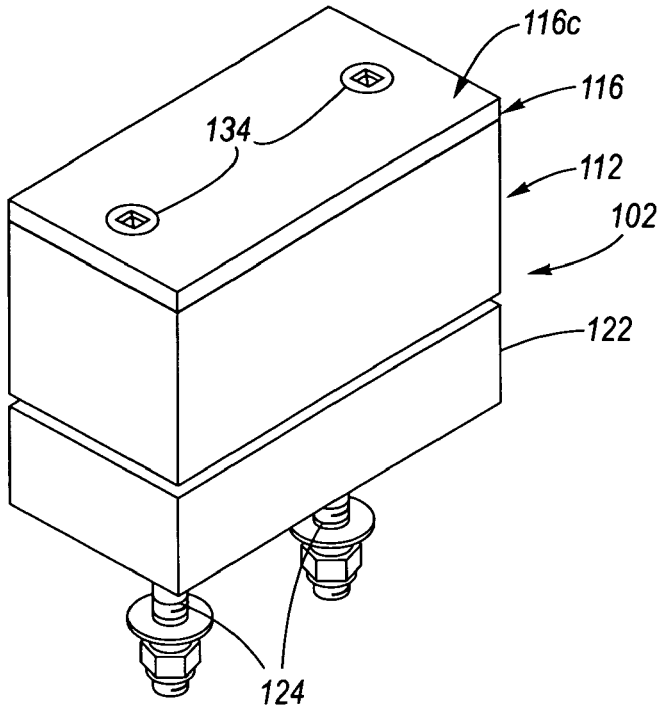
FIG. 4 is a perspective view of a magnetic source member of the magnetic open door retainer according to the present invention.
Figure 5:
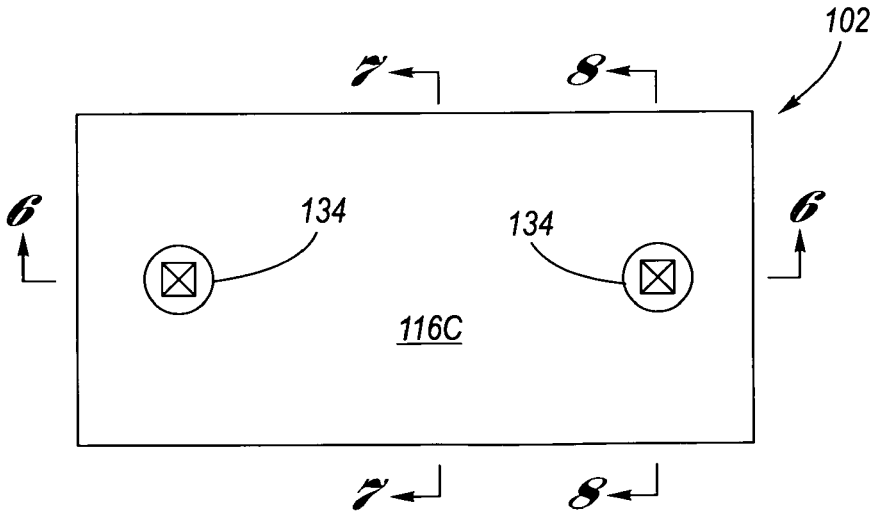
FIG. 5 is a top plan view of the magnetic source member of FIG. 4.
Figure 6:
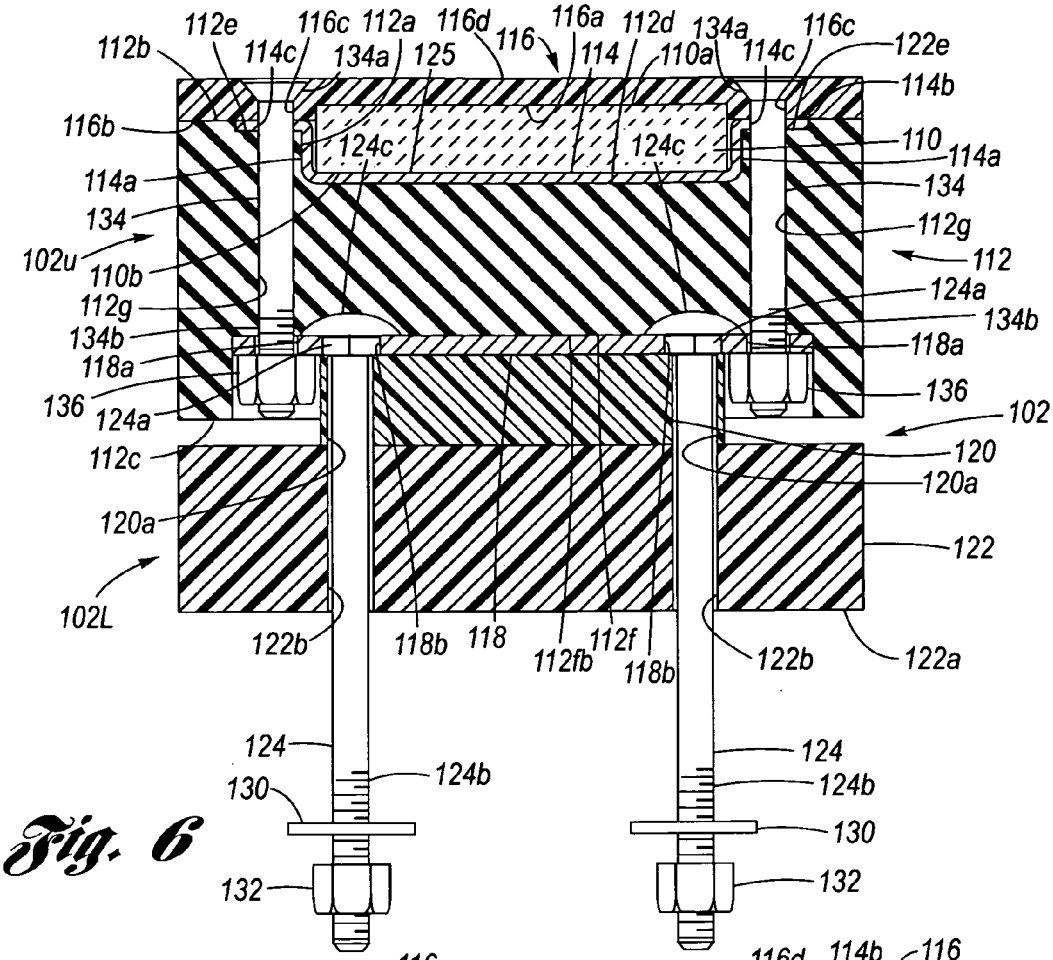
FIG. 6 is a sectional view, seen along line 6-6 of FIG. 5.
Figure 7:
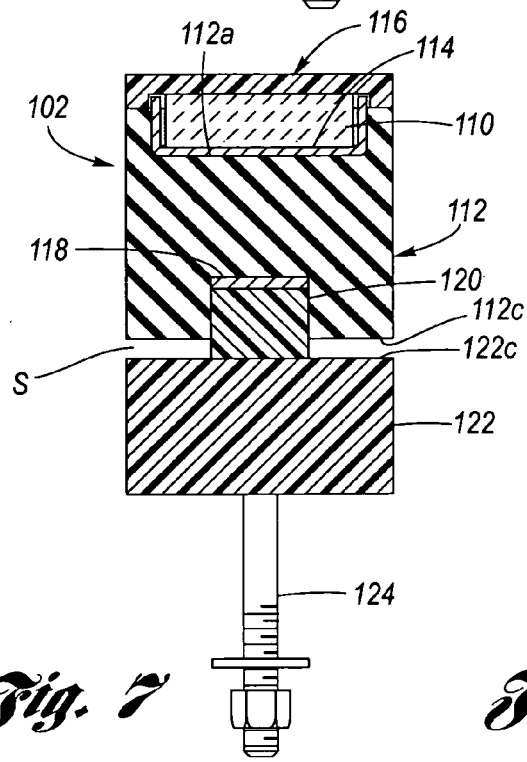
FIG. 7 is a sectional view, seen along line 7-7 of FIG. 5.
Figure 8:
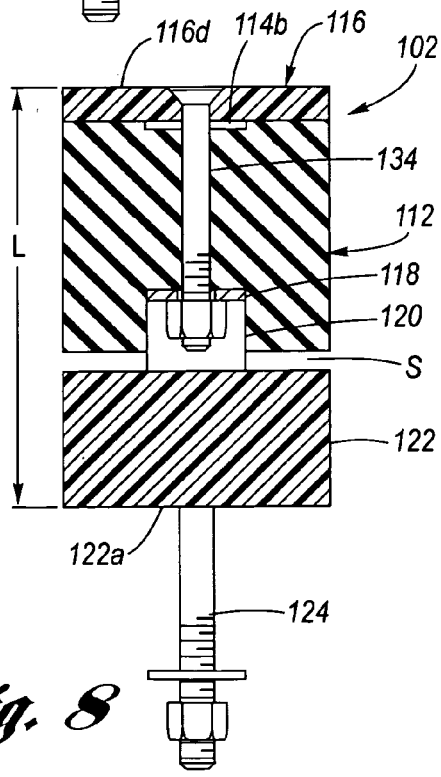
FIG. 8 is a sectional view, seen along line 8-8 of FIG. 5.
Figure 9:
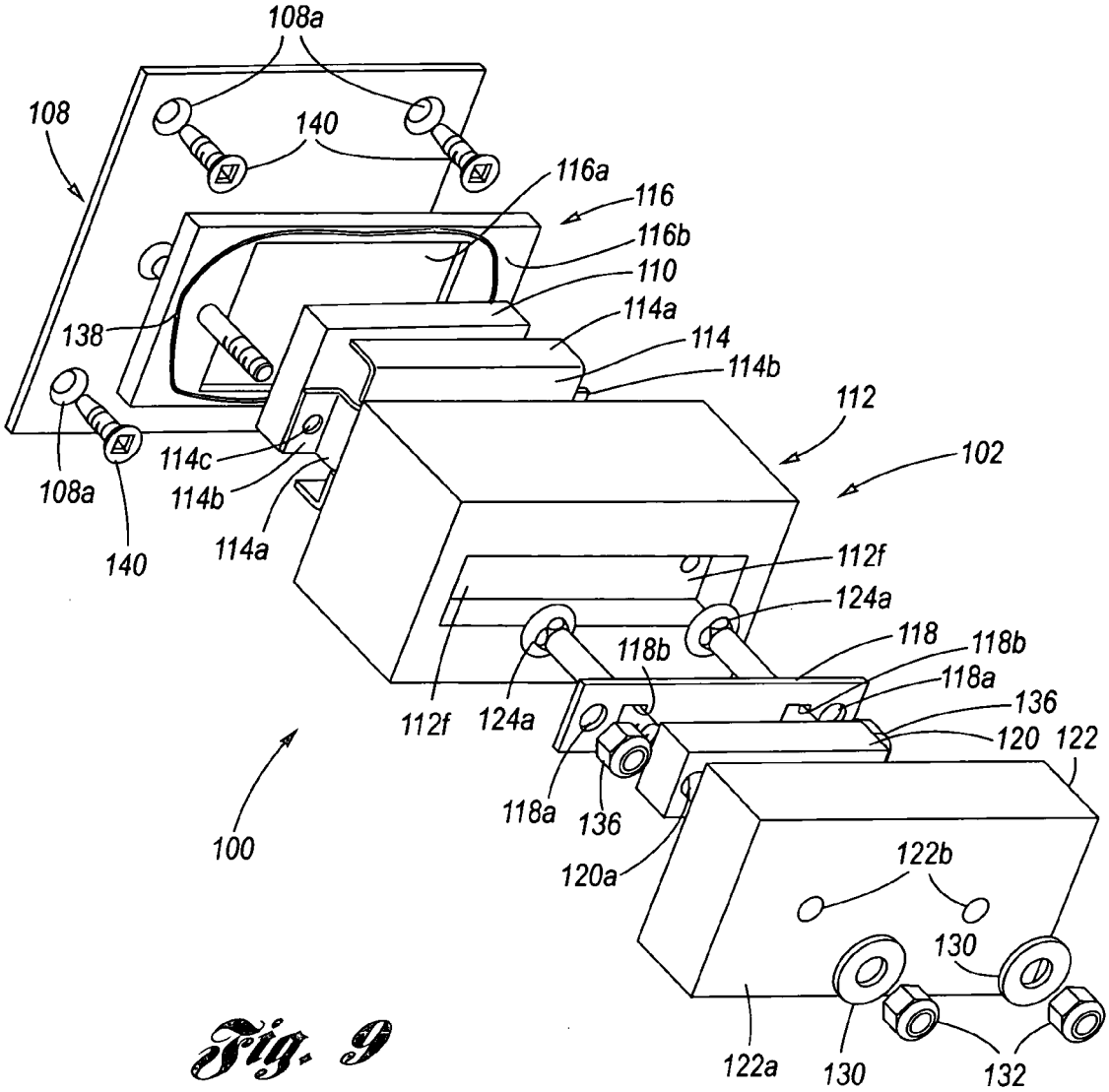
FIG. 9 is an exploded view of the magnetic open door retainer according to the present invention.

An environment of operation of the magnetic open door retainer 100 is depicted at FIG. 2, wherein a pair of identical magnetic source members 102 are shown, one attached to each of the left and right doors 104L, 104R of a trailer 106. At each of the left and right sidewalls 106L, 106R of the trailer 106 is a magnetically attractive plate 108 (see also FIG. 3), having a high magnetic permeability. Each of the magnetically attractive plates 108 is disposed on its respective left and right sidewall 106L, 106R so that when its respective door is at its fully open state, its respective magnetic source member 102 will abut it (see FIG. 10).

Referring additionally now to FIGS. 4 through 9 a preferred embodiment of each of the magnetic source members 102 will be detailed.

A high density magnetic field magnet 110, possibly an electromagnet but preferably a permanent magnet and most preferably a neodymium type permanent magnet having mutually opposing planar pole faces, an outer facing pole face 110*a* an inner facing pole face, 110*b* (any of which being a north or a south pole), is seated in a magnet seat cavity 112*a* of an elastomeric body 112. The elastomeric body 112 is elastomerically resilient and preferably composed of rubber, most preferably composed of ethylene propolene rubber, and has a planar upper surface 112*b*, whereat the magnet seat cavity is formed, and an oppositely disposed planar lower surface 112*c*.

It is preferred for a magnetic field keeper 114, preferably composed of a strip of galvanized steel, to be disposed at the bottom 112*d* of the cavity 112*a* so that the keeper abuts the inner facing pole 110*b*. The keeper 114 has upstanding keeper walls 114*a* which generally parallel the vertical walls of the cavity 112*a* (shown best at FIG. 9) and includes an attachment flange 114*b* at either end of the keeper which are recessed in keeper flange slots 112*e* formed at the upper surface 112*b* of the elastomeric body 112 at either side of the outer facing pole face 110*a*. The magnet 110 is seated in the keeper 114 and is preferably bonded 125 thereto, wherein a preferred bonding agent is an acrylic adhesive, as for example Locictite® SpeedBonder™ 326 available through Henkel Loctite Corp., Rocky Hill, Conn. 06067.

A contact pad 116 composed of a non-magnetic material, most preferably a plastic, and most preferably a high density polyethylene (HDPE) plastic, is located coverably adjoining the upper surface 112*b* of the elastomeric body 112, wherein the contact pad abuts the outer facing pole face 110*a*. In this regard, it is preferred for the outer facing pole face 110*a* to seat into a conforming magnet recess 116*a* formed at an inner pad surface 116*b* of the contact pad 116. The inner pad surface sealingly engages the upper surface 112*b* of the elastomeric body, wherein the seal may be enhanced by a sealant bead 138 (see FIG. 9) to ensure the magnet remains uncontaminated by debris.

A central recess 112*f* is formed in the elastomeric body 112 at the lower surface 112*c*. A pair of mounting holes 112*g* are formed in the elastomeric body 112 adjacent the magnet seat cavity 112*a* which extend from the keeper flange slots 112*e* to the central recess 112*f*. Each of the attachment flanges 114*b* of the keeper 114 have attachment holes 114*c* which align with the mounting holes 112*g*. Additionally, affixment holes 116*c* are provided in the contact pad 116 which are aligned also with the mounting holes 112*g*.

An interconnection plate 118, preferably composed of galvanized steel, is disposed at the bottom 112*fb* of the central recess 112*f*, wherein the interconnection plate has formed therein a first set of connection holes 118*a* which are aligned with the mounting holes 112*g*. The interconnection plate 118 further has a second set of connection holes 118*b* disposed adjacently inboard of the first set of connection holes 118*a*.

A spacer block 120 is located adjoining the interconnection plate 118 oppositely disposed in relation to the bottom 112*fb* of the central recess 112*f*. The spacer block 120 is preferably composed of a plastic, most preferably HDPE plastic, and is sized to protrude from the central recess 112*f*. A pair of spacer holes 120*a* are formed in the spacer block 120 which align with the second set of connection holes 118*b*.

A mounting block 122 is located adjoining the spacer block 120 oppositely disposed in relation to the interconnection plate 118. The mounting block 122 is preferably composed of a plastic, most preferably HDPE plastic, and is sized to provide a predetermined length L between a mounting surface 122*a* of the mounting block and the outer surface 116*d* of the contact pad 116. A pair of mount holes 122*b* are formed in the mounting block 122 which also align with the second set of connection holes 118*b*. The spacer and mounting blocks 120, 122 may be connected together as a single piece.

The foregoing described constituent components are assembled as follows.

A pair of round head, square neck carriage bolts 124 are received by, respectively, the second set of connection holes 118*b* (wherein the square neck 124*a* is seated at correspondingly squared shaped connection holes 118*b* to prevent relative rotation), the spacer holes 120*a* and the mount holes 122*b*. The shank 124*b* of the bolts 124 are threaded. A washer 130 is placed on the shanks 124*b*, then a nut 132 is threaded onto the shanks, wherein the nuts are preferably of the self-locking type, as for example nylock nuts. This then forms a lower assembly 102L of the magnetic source members 102, the remainder thereof constituting an upper assembly 102U.

The upper assembly 102U is assembled by a pair of bevel head machine bolts 134 being received, respectively, through the affixment holes 116*c* (whereat the beveled head 134*a* of the machine bolts 134 is recessed), the attachment holes 114*c*, the mounting holes 112*g*, and the first set of connection holes 118*a*, whereupon the upper and lower assemblies 102U, 102L are joined together. The shanks 134*b* of the machine bolts 134 are threaded and a nut 136 is threaded thereon to tightly secure the upper and lower assemblies together. The nuts 136 are preferably of the self-locking type, as for example nylock nuts.

Figure 10:
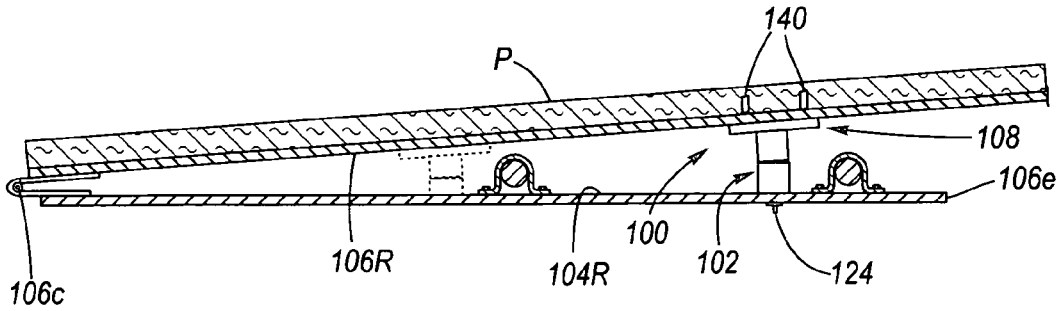
FIG. 10 is a partly sectional, broken-away view of the magnetic open door retainer according to the present invention, shown in operation with respect to a right sidewall and a right door of a motor vehicle conveyance component.

As shown best at FIGS. 2 and 10, the magnetically attractive plates 108 are composed of a highly magnetically permeable material, such as for example galvanized steel. A plurality of placement holes 108*a*, as for example four, are provided in the magnetically attractive plates 108, through which fasteners 140 pass, which may be screws (as shown, which screw into the plywood P of the sidewalls 106L, 106R, or may be rivets or bolt-nut combinations. The area of the magnetically attractive plates 108 is larger than the area of the contact pad 116 in order, during operation, to allow for relative sliding while yet retaining the magnetic attraction therebetween.

Turning attention particularly now to FIGS. 2, 3, 10 and 11, operation of the magnetic open door retainer 100 will be described, by way of exemplification, with respect to a conveyance in the form of a semi-trailer.

The sources of magnetic field 102 are mounted to each of the left and right doors 106L, 106R preferably high up and out of the reach of operators. In this regard, holes are drilled in the doors for accommodating the shanks 124*b* of the carriage bolts 124, whereupon the washers 130 are slipped on and the nuts 132 tightened.

Next, the location of the magnetically attractive plates 108 is determined by the doors being pivoted to the fully open state and making note of where on the left and right sidewalls the contact pad 116 makes contact therewith. Now, the magnetically attractive plates 108 are installed by drilling appropriate holes in the left and right sidewalls and using the fasteners 140 to complete the installation.

Operatively now, when either of the left and right doors 106L, 106R is pivoted to its respective fully open state, the respective magnetic source member 102 will magnetically clamp to the adjoining magnetically attractive plate 108 automatically without any manual manipulation on the part of the operator. To close the door, all the operator needs to do is grab the door end 106*e* (see FIG. 10) and then pull the door pivotingly away from the respective sidewall. In this regard, a mechanical advantage will favor the operator to release the magnetic clamping, wherein the position of the magnetic source member 102 may be closer to the hinge 106*c*, as shown in phantom in FIG. 10 to give the operator a better mechanical advantage.

The magnetic clamping force is preferably in the general range of between about twenty and forty pounds. The magnetic clamping force can be adjusted, for example, by selection of size and magnetic strength of the permanent magnet 110, its distance from the outer surface of the contact pad, the shape and size of the keeper 114 and the size and material of the magnetically attractive plate 108.

In order that magnetic clamping be reliable and secure, it is necessary for the outer pad surface 116*d* to flatly abut the magnetically attractive plate 108, whereby magnetic attraction of the permanent magnet 110 is at its optimum. Since the respective left or right door will be pivoting on a hinge and not necessarily parallel to the respective left or right sidewall when in the fully open state, it is attendantly necessary for the outer pad surface 116*d* to be acutely angled, or angularly adjustable, relative to the outer mounting block surface 122*a*.

Figure 11:
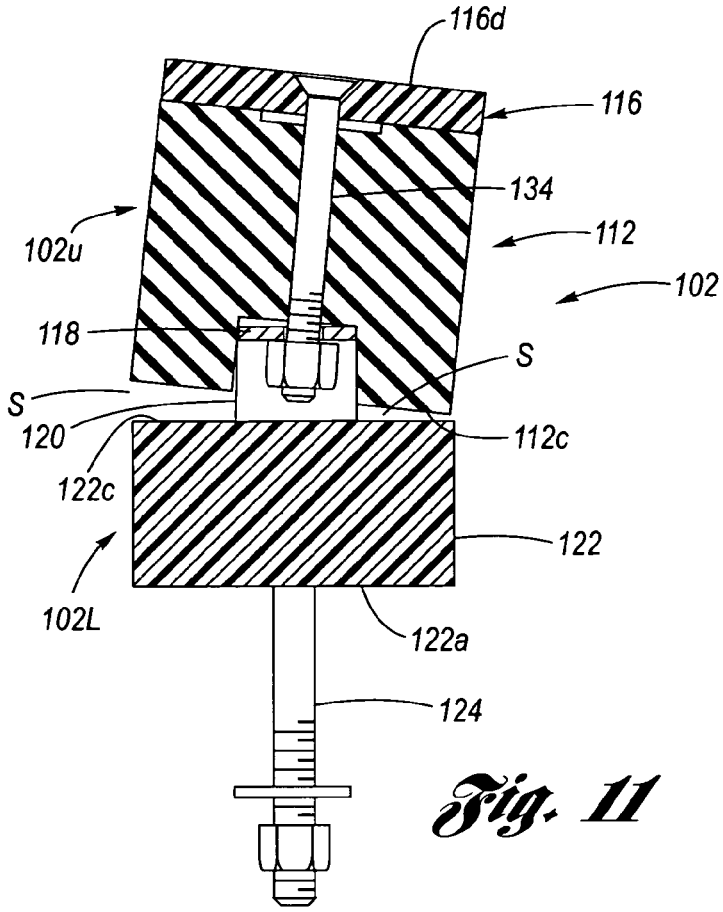
FIG. 11 is a sectional view of the magnetic open door retainer according to the present invention, showing articulation between upper and lower assemblies thereof.

FIGS. 10 and 11 demonstrate how the structure of the magnetic source members 102 articulate, wherein as best shown at FIG. 11, the elastomeric body provides resilient flexing, the over-size of the connection holes 118*a* relative to the shanks 134*b* (see FIG. 6), and the peripheral spacing S between the lower surface 112*c* of the elastomeric body 112 and the upper surface 122*c* of the mounting block 122 collectively contribute to provide the articulation.

Figure 12A:
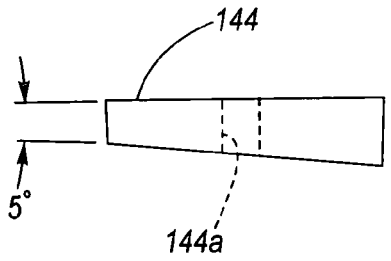
FIG. 12A is side view of a mounting wedge for the magnetic open door retainer according to the present invention.
Figure 12B:
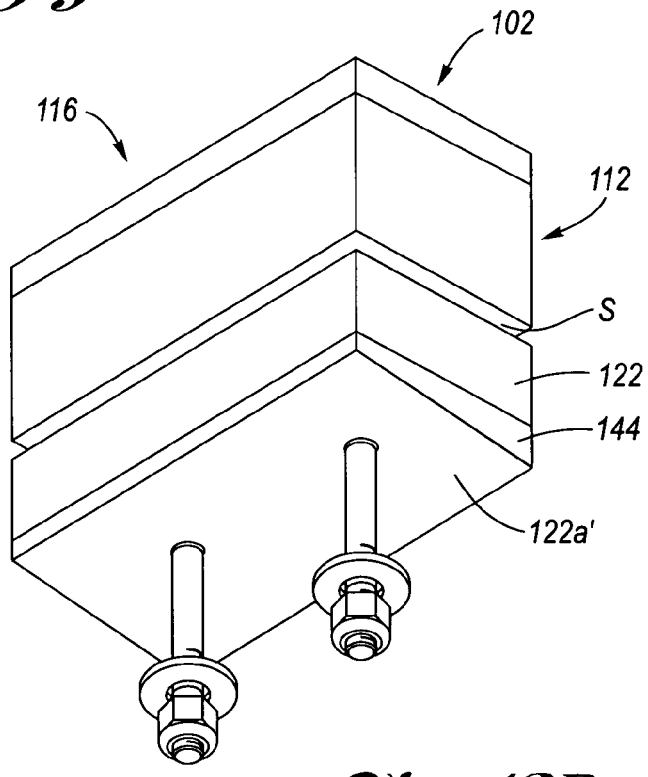
FIG. 12B is a perspective view of the magnetic open door retainer according to the present invention now including the mounting wedge of FIG. 12A.

As depicted at FIGS. 12A and 12B a wedge shaped block 144, composed preferably of HDPE plastic, may be added to the mounting block 122 (having mount holes 144*a* which align with mount holes 122*b* of the mounting block 122) to provide an angled mounting surface 122*a*', or the mounting block itself may have the outer surface thereof so angled. A preferred angle is five degrees, but this angle may be otherwise selected depending on the requirements of installation on a particular trailer.

A number of advantages of the magnetic open doors retainer 100 are provided, including with particular application to the trucking industry: automatic operation which does not require any operator training; as the source of magnetism 102 approaches the magnetically attractive plate 108, the door will be magnetically urged into its fully open state without operator intervention; the magnetic clamping will not release with sudden jarring or vibration; the magnetic clamping is operative in all weather conditions; the sources of magnetism and the magnetically attractive plates are inconspicuous and have out-of-the-way placement; the contact pad is able to slide on the magnetically attractive plates when the doors and sidewalls flex; the contact pad protects the permanent magnet from impact; the use of HDPE plastic enables excellent performance at high and low temperatures; the elastomeric body cushions and protects the permanent magnet from impact; in the event of an untoward situation during operation, as for example if a door becomes caught on some object during movement of the semi-trailer, the magnetic clamping will release (a feature not possible with chains or bungees); the magnetically attractive plates mount to the sidewalls of the semi-trailer without protrusion that could snag something; all components are corrosion resistant; the magnetically attractive plates have a surface area larger than the surface area of the contact pads so as to allow relative slip therebetween while yet magnetic clamping is unaffected; articulation of the magnetic source members ensures flat contact between the contact pads and the magnetically attractive plates; installation is simple and easy; a positive, cushioned stop is provided for each door so the latch rods do not hit the sidewall of the semi-trailer; magnetic clamping will release in the event the door is caught or forced without causing damage; and operation is instantaneous besides being automatic.

By way merely of exemplification, the following dimensions are provided. The length L may be about 3.16 inches, the dimensions of the contact pad may be about 4 inches by 2 inches in area and about 0.25 inches thick, the permanent magnet dimensions may be about 1.4 inches by 2.4 inches in area and about 0.40 inches thick, the elastomeric body has an area as that of the contact pad and a thickness of about 1.65 inches, and the spacing S may be about 0.10 inches.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A motor vehicle conveyance component comprising:

a semi-trailer comprising:

a left sidewall;

a right sidewall disposed opposite said left sidewall;

at least one door, each door being pivotally connected to a respective one of said left and right sidewalls, each door being pivotal between a closed state at which the door is oriented substantially normal to said left and right sidewalls and a fully open state whereat the door is in generally parallel adjacency to its respective one of said left and right sidewalls; and at least one magnetic open door retainer comprising:

a magnetic source member comprising:

a magnet;

an elastomeric body connected to a respective door of said at least one door, said elastomeric body having a cavity, said magnet being seated in said cavity;

a contact pad connected with said elastomeric body, said contact pad covering said magnet; and a magnetically attractive plate connected to one of said left and right sidewalls to which the respective door is connected;

wherein each said magnetic source member further comprises:

an upper assembly comprising:

said magnet;

said elastomeric body; and said contact pad; and a lower assembly connected to said elastomeric body, said lower assembly comprising:

an interconnection plate abutting said elastomeric body opposite said contact pad;

a mounting block connected to said interconnection plate;

a spacer block connected to said interconnection plate and disposed between said elastomeric body and said mounting block, said spacer block providing a peripheral spacing between said elastomeric body and said mounting block;

said interconnection plate being connected to said elastomeric body via shanks passing through over-size connection holes of said interconnection plate;

wherein said upper and lower assemblies articulate relative to each other; and wherein the elastomeric body provides resilient flexing, the over-size of the connection holes relative to the shanks, and the peripheral spacing between the elastomeric body and the mounting block collectively contribute to provide the articulation.

2. The motor vehicle conveyance component of claim 1, wherein said magnet is a neodymium type permanent magnet; and wherein said magnet attracts said magnetically attractive plate when said contact pad abuts said magnetically attractive plate with a force of substantially at least twenty pounds.

3. A method for selectively retaining a pivotal door of a semi-trailer in a fully open state with respect to a sidewall of the semi-trailer, comprising the steps of:

providing a source of magnetism having a contact surface;

providing a resiliently flexible member;

attaching the source of magnetism to the resiliently flexible member;

providing a mounting;

attaching the resiliently flexible member to the mounting by at least one shank passing through a respective oversized hole in the mounting such that the resiliently flexible member articulates with respect to the mounting, and wherein the resiliently flexible member resiliently flexes as it articulates with respect to the mounting;

attaching the mounting to the door of the semi-trailer;

attaching a magnetically attractive plate to the sidewall;

pivoting the door from a fully closed state to a fully open state;

articulating the resiliently flexible member with respect to the mounting when the flexible member contacts the magnetically attractive plate from an original orientation to a second orientation, wherein the resiliently flexible member resiliently flexes from an original shape to a flexed shape so that the contact surface orients into flat abutment with the magnetically attractive plate when the door is at the fully open state;

magnetically clamping the source of magnetism to the magnetically attractive plate when the contact surface flatly abuts the magnetically attractive plate automatically upon the door attaining the fully open state, wherein the source of magnetism magnetically clamps with a force of at least substantially twenty pounds onto said magnetically attractive plate;

pulling the door away from the sidewall so as to separate the contact surface from the magnetically attractive plate and thereby magnetically unclamp the source of magnetism from the magnetically attractive plate;

resiliently flexing the resiliently flexible member from the flexed shape to the original shape, wherein the resiliently flexible member articulates from the second orientation back to the first orientation; and pivoting the door to the fully closed state.

4. A method for selectively retaining a pivotal door of a motor vehicle conveyance component in a fully open state with respect to a sidewall of the motor vehicle conveyance component, comprising the steps of:

providing a source of magnetism having a contact surface;

providing a resiliently flexible member;

attaching the source of magnetism to the resiliently flexible member;

providing a mounting;

attaching the resiliently flexible member to the mounting by at least one shank passing through a respective oversized hole in the mounting such that the resiliently flexible member articulates with respect to the mounting, and wherein the resiliently flexible member resiliently flexes as it articulates with respect to the mounting;

attaching the mounting to one of the door and the sidewall of the motor vehicle conveyance component;

attaching a magnetically attractive plate to the other of the door and the sidewall;

pivoting the door from a fully closed state to a fully open state;

articulating the resiliently flexible member with respect to the mounting when the flexible member contacts the magnetically attractive plate from an original orientation to a second orientation, wherein the resiliently flexible member resiliently flexes from an original shape to a flexed shape so that the contact surface orients into flat abutment with the magnetically attractive plate when the door is at the fully open state;

magnetically clamping the source of magnetism to the magnetically attractive plate when the contact surface flatly abuts the magnetically attractive plate automatically upon the door attaining the fully open state, wherein the source of magnetism magnetically clamps with a force of at least substantially twenty pounds onto said magnetically attractive plate;

pulling the door away from the sidewall so as to separate the contact surface from the magnetically attractive plate and thereby magnetically unclamp the source of magnetism from the magnetically attractive plate;

resiliently flexing the resiliently flexible member from the flexed shape to the original shape, wherein the resiliently flexible member articulates from the second orientation back to the first orientation; and pivoting the door to the fully closed state.

* * * * *